United States Patent [19]

Stanford

[11] Patent Number: 4,635,657

[45] Date of Patent: Jan. 13, 1987

[54] NAIL POLISH DISPENSING SYSTEM

[76] Inventor: Sheila A. Stanford, 817 St. Paul St., Apt. 102, Baltimore, Md. 21202

[21] Appl. No.: 746,642

[22] Filed: Jun. 20, 1985

[51] Int. Cl.[4] ..... A45D 33/00

[52] U.S. Cl. ..... 132/83 R; 132/79 R

[58] Field of Search ..... 132/83 R, 73, 79

[56] References Cited

U.S. PATENT DOCUMENTS

| | | | |
|---|---|---|---|
| 1,453,249 | 4/1923 | Rope | 132/83 R |
| 1,463,259 | 7/1923 | Flagg | 132/83 R |
| 1,735,183 | 11/1920 | Salerno . | |
| 1,916,236 | 7/1933 | Soffel . | |
| 1,947,604 | 2/1934 | Lewis . | |
| 2,242,016 | 5/1941 | McKinney, Jr. | 132/73 |
| 2,248,689 | 7/1941 | Porter | 132/83 R |
| 4,326,546 | 4/1982 | Acker . | |

*Primary Examiner*—Gregory E. McNeill
*Attorney, Agent, or Firm*—John F. McClellan, Sr.

[57] ABSTRACT

A system for preventing accumulation of partially used fingernail finishing materials includes four disk-shaped containers, each with a capacity for containing one application of a nail finishing material of a set, such as nail polish, cuticle remover, ridge filler and top polish. A flexible holder has a cylindrical shape proportioned for holding four containers in coaxial relation, and a door-closable opening proportioned for fitting the containers so that the containers snap-fit through the opening. The containers have flexible handles on which the door presses when closed. A tree, that preferably is supplied in kit form, holds four containers comprising typically a one-month supply, one to an arm protrusive from the tree stem, which is fitted to a supportive base.

2 Claims, 5 Drawing Figures

NAIL POLISH DISPENSING SYSTEM

FIELD OF THE INVENTION

This invention relates generally to containers and specifically to a container system for preventing the need to use stale nail polish.

Once opened, a container of nail polish tends to lose the volatile solvent, usually amyl acetate, and becomes gummy. Gummy nail polish produces a rough finish on the nails, makes application slow and difficult and can result in a thicker layer than necessary, wasting nail polish. Once opened, containers of cuticle remover, ridge filler and top coat, also tend to lose the volatile solvents in the containers. Once-used, brushes can be another source of unsatisfactory results because of loss of flexibility and loss of separation between bristles.

BRIEF SUMMARY OF THE INVENTION

A principal object of this invention is to provide a system that produces superior, predictable results in finger nail finishing in that it avoids the use and the temptation to use once-opened nail polish and accessory fluids.

Further objects are to provide a system as described that is economical, convenient and easy to use, and that displays the color of the nail polish in it.

Yet further objects are to provide a system as described that prevents nail polishing materials from getting hidden on the dressing table, that indicates at a glance how much of nail polishing materials, including brushes, is on hand so that the user can always keep a supply ready ahead of time.

And further objects are to provide a system as described that is decorative in appearance, compact in size, safe to use, and has container elements that are matched in quantity for providing correct proportions to use each time.

And further objects are to provide a system as described that makes easy and quick the discard of exhausted elements thereof.

A system for preventing accumulation of partially used fingernail finishing materials includes four disk-shaped containers, each with a capacity for containing one application of a nail finishing material of a set, such as nail polish, cuticle remover, ridge filler and top polish. Heat sealed tear-off strips with integral handles may be used for opening the containers, or alternatively, they may snap apart. A flexible holder has a cylindrical shape proportioned for holding four containers in coaxial relation, and a door-closable opening proportioned for fitting the containers so that they snap-fit through the opening. The containers have flexible handles on which the door presses when closed. A tree, that preferably is supplied in kit form, holds four containers comprising typically a one-month supply one to an arm protrusive from the tree stem, which is fitted to a supportive base.

PRIOR ART

In the prior art, various containers and container systems are known:

U.S. Pat. No. 4,326,546 granted to S. Acker on 4-27-82, disclosed a hanging display for lipstick containers;

U.S. Pat. No. 1,916,236 granted to A. L. Soffel on 7-4-33, disclosed a cabinet for cosmetic containers such as round boxes and tubes, that has slide slots to permit removal of the contents; evidently removal would be only from the top;

U.S. Pat. No. 1,947,604 granted to F. N. Lewis on 2-234 shows a means of holding adjacent containers;

U.S. Pat. No. 1,735,183 granted to F. Salerno on 11-12-20, disclosed a container having an opening with rounded walls and front slot.

However, no system having the advantageous characteristics of the system of the invention is believed to have been known or before available.

BRIEF DESCRIPTION OF THE DRAWING

The above and other objects and advantages of this invention will become more readily apparent on examination of the following description, including the drawings in which like reference numerals refer to like parts.

DETAILED DESCRIPTION

Figure 1:
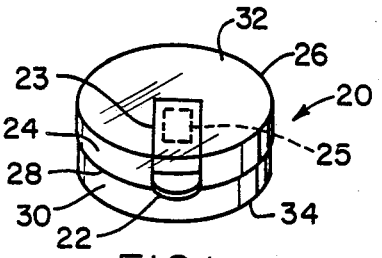
FIG. 1 is a perspective view of a container.

FIG. 1 shows a single-use container 20; all may be alike in this embodiment.

The invention includes a plurality of these single-use quantity containers 20. They may be of metal, but preferably are of transparent thermoplastic, of any suitable conventional type that is resistant to nail finishing solvents. Each container has a flexible handle 22 protrusive from the circumference 24 of the upper half 26. The handle may be integral or it may be cemented-on. The handle 22 may be a thicker portion of a thin heat-sealed flap 23 covering an opening 25 from which it can be pulled loose to open the container. The containers cannot later be reclosed. Preferably, also, the containers are of circular pillbox construction with sliding hermetric interfit between the respective rims 28, 30, and having flat top 32 and bottom portions, for ease in filling.

Figure 2:
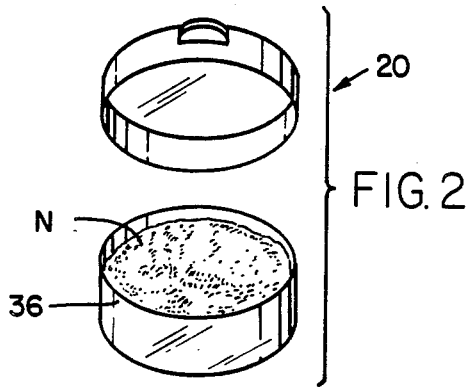
FIG. 2 is a perspective view of the container opened.

FIG. 2 shows a container 20 in open position with a full quantity of nail polish N in the bottom half 36, just enough for covering the nails of both hands, called "one polishing".

Figure 3:
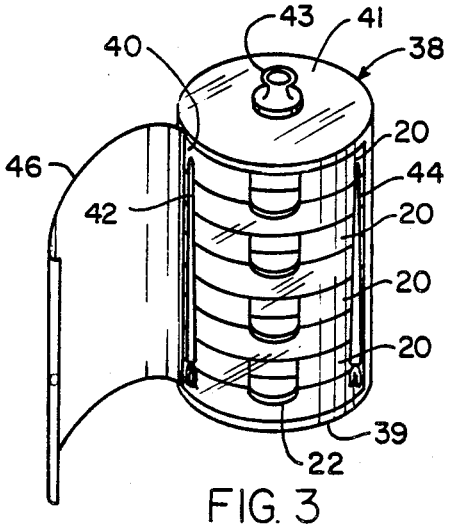
FIG. 3 is a perspective view of a plurality of the containers assembled in a dispensing holder together with brushes.

FIG. 3 shows further elements of the invention, three more containers, 20, for cuticle remover, for ridge filler and for top polish, in addition to the nail polish container which is at the top for best color visibility. Also shown are cylindrical, dispensing holder 38 with flat bottom 39 and top 41 that aligns the four containers coaxially in vertical array. Diameter of the holder 38 is larger than that of the containers but the opening 40 through which the containers pass is nearly as great as the diameter of the container.

The containers cause the holder 38 to flex when they are passed into it so that they snap in place and cannot fall free. They are drawn out (snapped out) by the respective handles 22.

Within the sides of the opening 40 in the holder are two nail brushes 42, 44, secured by means to be described, and also further secured as are the containers, by integral flexible arcuate door 46.

On the top 41 of the holder 38 a preferably integral and substantially coaxial horizontally open eye 43 provides means for hanging the holder and contents.

Figure 4:
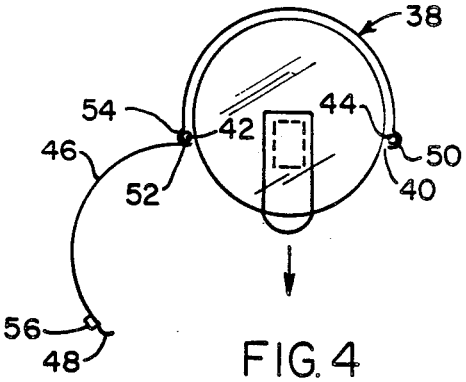
FIG. 4 is a partly sectional plan view.

FIG. 4 shows that when the door 46 closes over the opening 40 it affixes in the closed position by a hooked free end 48 that engages the outer wall of a protrusive channel 50 framing the far edge of the opening 40. Preferably the integral flexible plastic hinge 52, at the side of the door has a second channel 54 like the first; each is proportioned to house one of the conventional nail brushes 42, 44 that become accessible by flexure of the holder 38, snapping in and out as desired.

For better grip in closing the flexible door, the free edge may have a knob-like protrusion 56 formed on it. When the door is closed it compresses the flexible handles so that the assembly is rattle-free for shipment.

The contents of each holder as noted supply one ten-nail finishing quantity, substantially. One finishing lasts for a week usually. From one to three weeks supply of nail finishing materials are desirable to keep on hand, and the amount in reserve can be told at a glance, even among the normal clutter of items on a dressing table, according to this invention.

Figure 5:
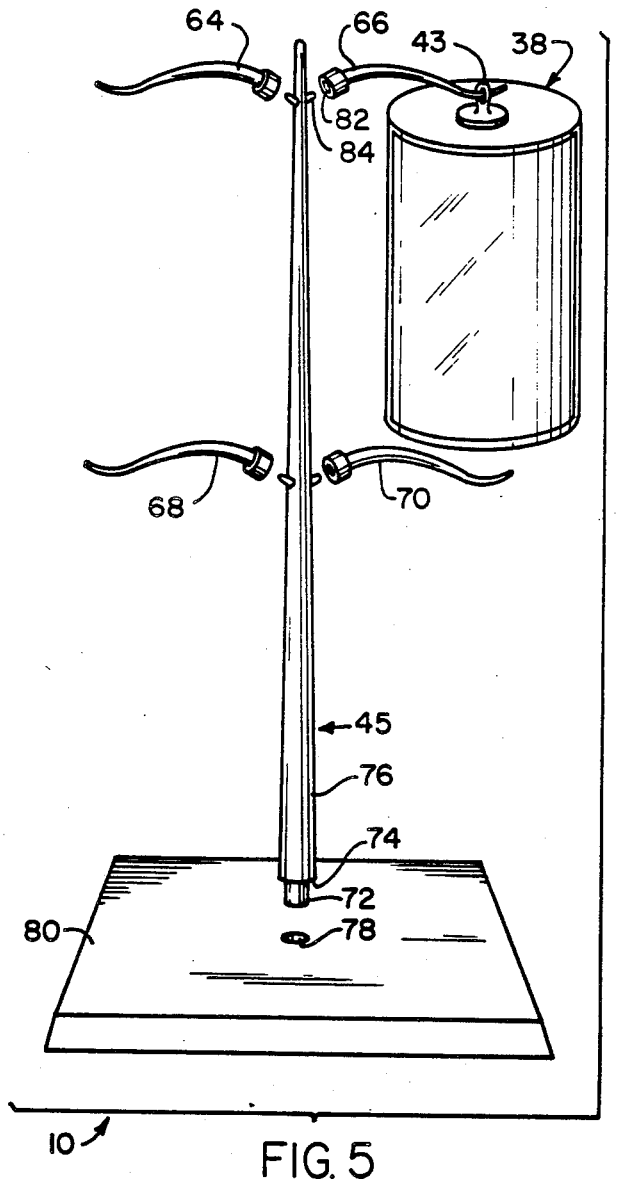
FIG. 5 is a partially exploded perspective view of a tree for holding containers and brushes in dispensing holders.

FIG. 5 shows the final portion making up embodiment 10 of this invention, a tree 45 upon which a supply of containers, in holders 38, preferably four, can be hung by the respective eyes 43 on four in-plane arms 64, 66, 68, 70.

The arms, which are in opposed pairs at two levels, are curved upwardly so that the holders won't slip off.

Assembly from the knocked-down kit form of the tree requires only inserting the smaller portion 72 below the shoulder 74 of the vertical stem 76 in the hole 78 in the base 80, and then snapping the collared end recesses 82 of the arms onto respective spuds 84 protrusive at an upwardly angle from the sides of the stem. The tapering-smaller shape of the arms 64, 66, 69, 70 towards the outer portion and similarly of the vertical stem 76, and the flat base, give the embodiment an attractive appearance, particularly when two or more holders are on it.

Material for the holders may be any suitable transparent flexible thermoplastic; the tree may be of the same or similar material.

By limiting the quantity of nail finishing material per holder and container, the invention eliminates the production of gummy nail polish and other waste associated with such.

Although the containers are shown as the same size, which may be a half inch to three-quarters inch (12 mm to 18 mm) in diameter, it will be appreciated that the depth of the containers can be less in some than in others, for example 1/16 inch to ⅛ inch (1.5 mm to 3 mm) to reflect the lesser quantities of some materials needed, for example from 5 to 10 drops. Polyethylene is a suitable material for the containers and for the other parts of the apparatus.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. A system for preventing accumulation of partially used nail finishing materials, for avoiding use of gummy nail finishing materials and for displaying type and quantity on hand of nail finishing materials used in sets, comprising: a plurality of separate containers, each container proportioned for holding one application of nail finishing materials, a holder proportioned for holding one container on top of another, the plurality of containers containing a said set, a tree having a plurality of arms, each arm proportioned for suspending one holder therefrom, each container being disk-like in shape with interfitting top and bottom; said holder being cylindrical in shape with top and bottom, structure forming an opening longitudinally along one side of the holder for receiving and dispensing a plurality of said containers, the structure forming said opening proportioned for retentively fitting the circumference of each container and causing it to snap through the opening when removed therefrom, a door for closing said opening comprising a flexible arcuate member hinged at one side of the opening, said door having a hook-shaped free end, a first channel at an edge of said opening for engaging and holding closed said door hook-shaped free end, each container having a handle radially protrusive therefrom, and said holder and door proportioned for the door to press on said handles when closed.

2. A system for preventing accumulation of partially used nail finishing materials, for avoiding use of gummy nail finishing materials and for displaying type and quantity on hand of nail finishing materials used in sets, comprising: a plurality of separate containers, each container proportioned for holding one application of nail finishing materials, a holder proportioned for holding one container on top of another, the plurality of containers containing a said set, each container being disk-like in shape with interfitting top and bottom, said holder being cylindrical in shape with top and bottom, structure forming an opening longitudinally along one side of the holder for receiving and dispensing a plurality of said containers, the structure forming said opening proportioned for retentively fitting the circumference of each container and causing it to snap through the opening when removed therefrom, a door for closing said opening comprising a flexible arcuate member hinged at one side of the opening, said door having a hook-shaped free end, a first channel at an edge of said opening for engaging and holding closed said door hook-shaped free end, each container having a handle radially protrusive therefrom, and said holder and door proportioned for the door to press on said handles when closed.

* * * * *